United States Patent [19]

Sohn

[11] Patent Number: 4,850,311

[45] Date of Patent: Jul. 25, 1989

[54] THREE DIMENSIONAL CAM CARDANIC FOLLOWER VALVE LIFTER

[75] Inventor: Do Y. Sohn, Mt. Clemens, Mich.

[73] Assignee: General Motors Corporation, Detroit, Mich.

[21] Appl. No.: 281,611

[22] Filed: Dec. 9, 1988

[51] Int. Cl.[4] ..... F01L 1/14; F01L 1/34

[52] U.S. Cl. ..... 123/90.18; 123/90.27; 123/90.48

[58] Field of Search ..... 123/90.18, 90.2, 90.27, 123/90.28, 90.48, 90.5

[56] References Cited

U.S. PATENT DOCUMENTS

| | | | |
|---|---|---|---|
| 1,802,330 | 4/1931 | Boland | 123/90.5 |
| 2,935,878 | 5/1960 | Wirsching | 123/90.5 |
| 3,139,076 | 6/1964 | Flaherty | 123/90.5 |
| 3,180,328 | 4/1965 | Engle | 123/90.5 |
| 3,303,833 | 2/1967 | Melling | 123/90.48 |
| 3,915,129 | 10/1975 | Rust et al. | 123/90.18 |
| 4,393,820 | 7/1983 | Maki et al. | 123/90.41 |
| 4,517,936 | 5/1985 | Aragona | 123/90.5 |
| 4,693,214 | 9/1987 | Titolo | 123/90.18 |
| 4,773,359 | 9/1988 | Titolo | 123/90.22 |

FOREIGN PATENT DOCUMENTS

| | | | |
|---|---|---|---|
| 2938283 | 4/1981 | Fed. Rep. of Germany | 123/90.48 |
| 0087833 | 7/1980 | Japan | 123/90.18 |

OTHER PUBLICATIONS

"The Fiat Variable Valve Timing", A. Titolo, Fiat Auto S.p.A., Torino, published by TEIS Europe, Oct. 30, 1985.

*Primary Examiner*—Charles J. Myhre
*Assistant Examiner*—Weilun Lo
*Attorney, Agent, or Firm*—Robert J. Outland

[57] ABSTRACT

A direct acting valve lifter reciprocable in a bore has a pivoting foot for following a three dimensional cam for use with a variable valve lift mechanism of the type having an axially movable camshaft with tapered lobes used to vary valve lift. A rotatable shim on the foot rides on a lubricant film to provide a low friction cam follower. The pivoting foot has a cylindrical convex bearing surface which rolls on a concave cylindrical bearing surface carried by a follower retainer. The bearing surfaces have relative radii of curvature of 2:1 to achieve cardanic rolling motion. A tooth on the foot cooperates with a recess in the retainer to prevent sliding between the cylindrical surfaces.

7 Claims, 3 Drawing Sheets

THREE DIMENSIONAL CAM CARDANIC FOLLOWER VALVE LIFTER

TECHNICAL FIELD

This invention relates to a direct acting valve lifter and, in particular, to a direct acting 3-dimensional cam cardanic flat follower valve lifter for use with a variable valve lift mechanism of the type having an axially movable camshaft with conical or tapered cam lobes thereon used to vary valve lift.

BACKGROUND

The desirability of varying valve lift, as desired, in a vehicle engine so as to improve engine operation and fuel economy at all engine speeds has long been recognized. Accordingly, various types of variable valve lift train mechanisms have been proposed.

One such type of variable valve timing and lifting system for overhead cam engines with 2, 3 or 4 valves per cylinder, which has been proposed and built by Fiat Auto S.p.A. of Torino, Italy, uses the longitudinal movement of an overhead camshaft to provide different valve lifting due to conical cam with each such conical cam engaging a multiple piece direct acting valve lifter which includes a cam follower or foot operatively and pivotally supported by a pivotal shaft element for actuating a conventional cylindrical tappet, the latter being slidably journaled in a tappet guide bore provided for this purpose in the cylinder head of an engine, to control the opening and closing movement of an associated valve, either intake or exhaust, and a guide to, in effect, maintain the orientation of the cam follower or foot so that it can pivot about a pivot axis located at right angles to the rotating axis of the overhead camshaft.

In such prior known multiple piece direct acting valve lifters as described hereinabove, even though the cam follower or foot of the lifter is pivotably supported so that it will ride substantially flat against the surface of an associated cam, the pivotal movement of the cam follower or foot on its pivotal shaft support element is not a true rolling contact movement but instead it is actually a sliding motion, which results in a relatively high frictional loss in such a lifter.

Another example of a valve lifter for following a conical cam is shown in U.S. Pat. No. 3,303,833 to Melling wherein the follower has a ball and socket coupling to the lifter body. The pivoting action is a sliding motion between the ball surface and the socket surface.

To avoid the frictional loss in such lifters it is here proposed to incorporate a rolling contact, particularly a cardanic rolling motion, into a valve lifter to allow pivoting of a follower without sliding motion. The U.S. Pat. No. 4,393,820 to Maki et al entitled "Rolling Contact Arm and Pivot", which is incorporated herein by reference, discloses the details of cardanic rolling motion as applied to a valve train, particularly to a rocker arm pivot. The geometrical relationships and the freedom from sliding are fully explained therein. To further avoid frictional loss it is also proposed here to provide a rotating cam follower to overcome the wear due to sliding cam action on the lifter.

SUMMARY OF THE INVENTION

It is therefore an object of the invention to provide a valve lifter with a flat follower mounted for rolling contact pivotal movement for use in an engine with an axially shiftable overhead camshaft having conical cams thereon. It is a further object to provide a low friction rotating cam follower.

The invention is carried out by a direct acting cam follower valve lifter comprising; a follower body having a tubular wall portion adapted to be slidably journaled in the lifter guide bore in the cylinder head, a follower retainer in one end of the follower body and having an outboard bearing surface adjacent the said one end of the follower body, a shim support having an inboard bearing surface adapted to engage the outboard bearing surface of the retainer, and a shim supported on the outboard side of the shim support, the outboard bearing and inboard bearing surfaces being of semi-cylindrical configuration with the radius of the outboard bearing surface having a radius larger than the radius of the inboard bearing surface for rolling contact between the bearing surfaces, and one of the bearing surfaces having a guide recess and the other bearing surface having a guide extending into the said guide recess for maintaining the rolling contact of the bearing surfaces.

The invention further comprehends mounting the shim on the shim support for rotation on a film of lubricant due to cam forces.

The invention further comprehends bearing surfaces in the above described valve lifter wherein the outboard bearing surface has a radius substantially twice the radius of the inboard bearing surface to achieve cardanic rolling contact between the bearing surfaces.

BRIEF DRAWING DESCRIPTION

The above and other advantages of the invention will become more apparent from the following description taken in conjunction with the accompanying drawings wherein like references refer to like parts and wherein:

FIG. 1 is a sectional view through a portion of an internal combustion engine of the overhead cam variable valve lift type having a direct acting valve lifter in accordance with the invention incorporated therein, with some parts shown in elevation and showing the camshaft in a low lift position and with the valve lifter riding the cam base circle.

FIG. 2 is a view of the valve lifter like FIG. 1 but with the valve lifter riding the cam lobe and the camshaft in low lift position, FIG. 3 is a view of the valve lifter like FIG. 2 but with the camshaft in high lift position, FIG. 4 is an exploded perspective view of the valve lifter of FIG. 1, FIG. 5 is an outline of a follower retainer and a shim support of FIG. 1 illustrating the geometrical relationship of their bearing surfaces, FIG. 6 is an enlarged elevation of the shim support of the valve lifter of FIG. 1, FIG. 7 is a top view of the valve lifter taken along line 7—7 of FIG. 1 with a partly broken away section of the head showing an anti-rotation feature, and FIG. 8 is a sectional view of another embodiment of the valve lifter according to the invention and showing the camshaft in a low lift position with the valve lifter riding on the cam base circle.

DETAILED DESCRIPTION

Figure 1:
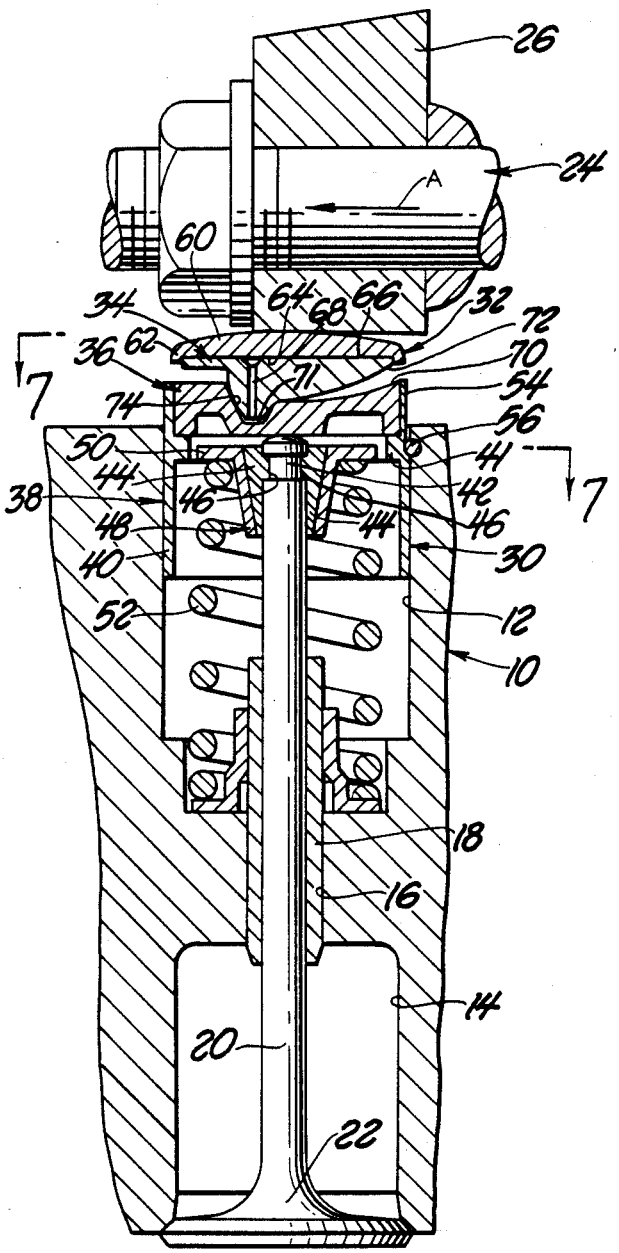
Figure 2:
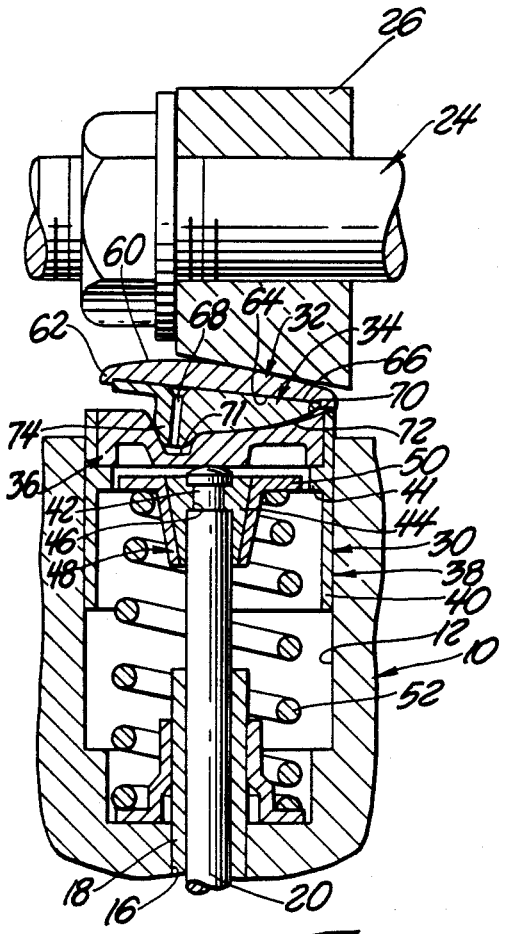
Figure 3:
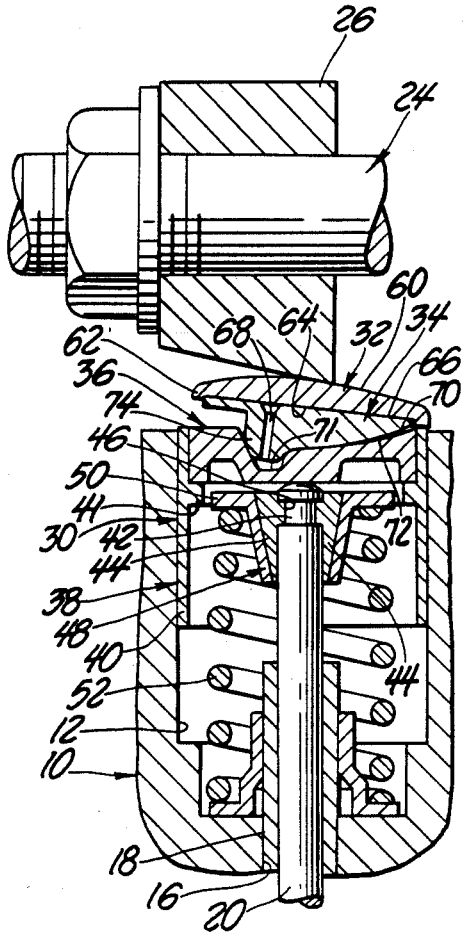

Referring to FIG. 1, a section of an engine head 10 incorporates a valve lifter bore 12 aligned with an intake or exhaust passage 14 and interconnected by a small bore 16 fitted with a valve guide 18 which slidably holds the stem 20 of a valve 22 for movement between open and closed position, the latter position being shown in FIG. 1. A camshaft 24 is shown above the lifter bore in general alignment therewith and is mounted by means, not shown, for controlled axial movement for the purpose of varying the valve lift, the shaft being shown in its full right position. The camshaft 24 has a cam 26 which is conical, having a lobe on its upper side, as viewed in FIG. 1, which lineally increases in size toward the right end of the shaft 24 so that upon rotation when the shaft is at the full right position, as shown in FIG. 2, a minimum amount of valve lift will occur. When, however, the camshaft 24 is moved toward the left as indicated by the arrow "A", the increased lobe size is effective to open the valve further, as illustrated in FIG. 3, and to maintain the valve open longer.

To accommodate the shaft movement and, in particular, to accommodate the angle of the conical cam 26, a lifter 30 in the bore 12 has a circular cup-shaped follower foot or shim 32 mounted on a shim support 34 which, in turn, is carried by a follower retainer 36 in a manner for the shim 32 and shim support 34 to rock or pivot to conform to the changing angle of the cam 26 as the camshaft 24 rotates. The follower retainer 36 is mounted in a follower body 38 which is slidably carried in the lifter bore 12 for movement in response to the cam 26 rotation. The body 38 comprises a tubular wall 40 having an internal annular flange 41 near the outboard end which seats the retainer 36 such that the retainer reaches the outboard end of the wall 40. The follower body 38 and the retainer move together in the bore 12 and preferably are secured together by a press fit. Alternatively, they may be integrated into one piece.

The valve stem 20 extends into the lifter bore 12 along the bore axis and has a groove 42 near the upper end of the stem. A pair of semi-annular keys 44 each with a conical outer surface and an inner tab 46 for fitting into the groove 42 are secured to the stem 20 by a conical end cap 48 having an outwardly flared flange 50. A valve spring 52 surrounding the stem is compressed between the flange 50 and the bottom of the bore 12 so that the end cap is urged into tight engagement with the keys 44 and the valve 22 is biased toward its closed position. The lower surface of the follower retainer 36 bears against the top of the valve stem 20 to push the valve open when the retainer is depressed by cam action and similarly the retainer and the follower are moved up by the spring 52 when the cam releases the retainer and the valve closes. Thus the valve lifter reciprocates in the bore 12 and the valve opens and closes in response to cam rotation.

Figure 4:
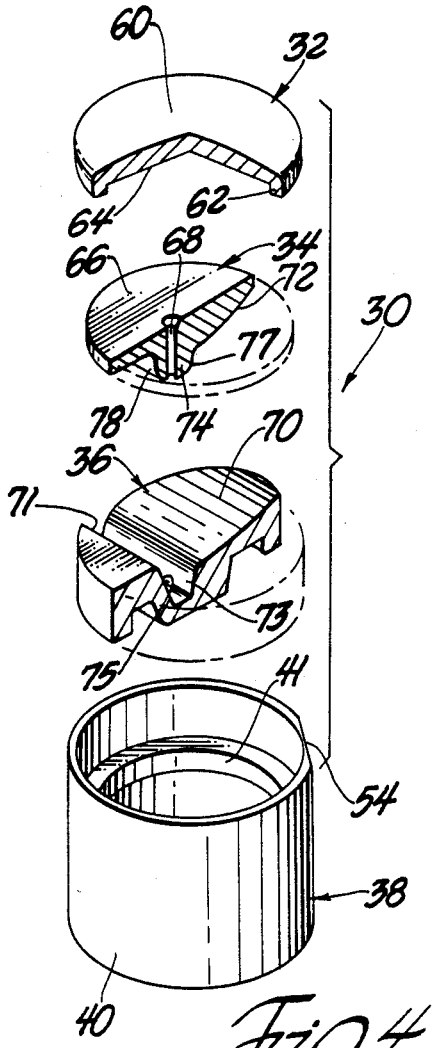
Figure 7:
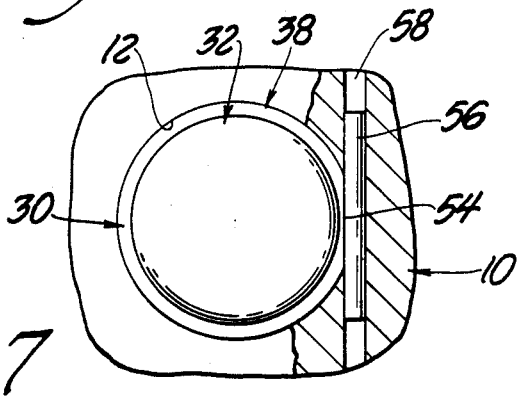

FIG. 4 shows the valve lifter parts in exploded view. The body 38 has a flat 54 formed on its outer surface extending from the top down to at least the region of the flange. As also shown in FIG. 7, this permits a pin 56 in a bore 58 transverse to the lifter bore 12 to engage the flat 54 to prevent rotation of the body 38 and retainer 36 but allows reciprocation of the lifter. The shim 32 has a slightly rounded crown 60 for contact with the cam, a depending peripheral flange 62 for encircling the shim support 34, and a flat inboard surface 64 to mate with a similar flat surface 66 on the support 34. The shim 32 is intended to rotate as the cam rotates across its crown, thereby distributing the wear on the shim. To enhance the rotation an oil passage 68 extends through the shim support 34 to permit lubrication of the flat mating surfaces 64 an 66. The shim then rotates on a film of oil under cam action to prevent localized wear due to the cam sliding on the shim.

Figure 5:
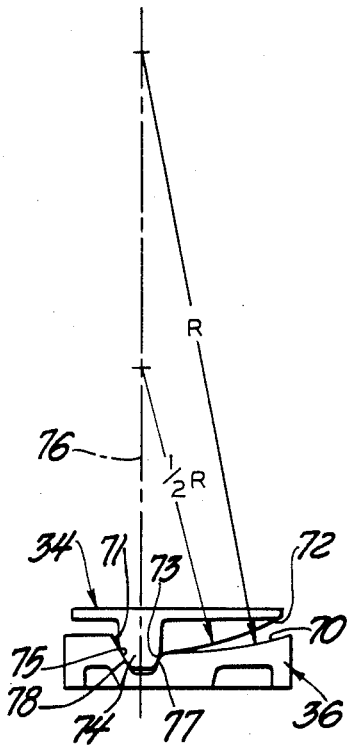

The shim support 34 and the shim retainer 36 are designed to achieve cardanic rolling motion when the shim support tilts to conform to the cam angle. Cardanic motion is the plane motion of a circle or cylinder rolling inside another circle or cylinder, respectively, twice its size without slippage at the contact point or line between the elements. A tooth and slot arrangement insure against slippage. As best shown in FIG. 5, the retainer 36 has a cylindrical concave outboard bearing surface 70 having a radius R and the support 34 has a cylindrical convex inboard bearing surface 72 having a radius of $\frac{1}{2}$ R. Further the retainer has a guide slot or recess 71 formed of straight sloped sides 73 and 75 facing the support 34 and offset from the center axis of the valve lifter to form a chord across the retainer at right angles to the camshaft 24. A guide pin or tooth 74 depending from the inboard surface of the shim support 34 is positioned in mating alignment with the slot 71. The tooth and slot respectively form a boundary of each of the bearing surfaces. The axis 76 through the tooth and slot parallel to the lifter center axis passes through the centers of curvature of the bearing surfaces 70 and 72, assuming the support is not tilted. When it is tilted the center of curvature of the surface 72 moves in the direction of tilt. The bottom of the tooth 74 is spaced from the bottom of the slot 71 to form a cavity. The rocking motion of the tooth in the slot produces a pumping action to circulate oil through the passage 68 for lubricating the shim.

Figure 6:
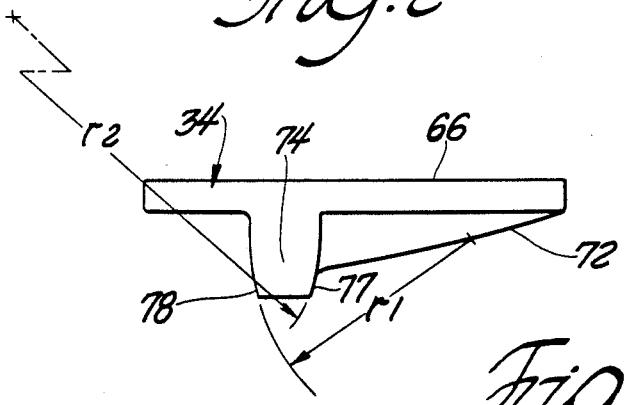

FIG. 6 shows the shim support 34 in outline. The side 77 of the tooth 74 nearest the bearing surface 2 is a cylindrical surface with a radius of curvature of r2 and makes a line contact with the side 73 of the slot 71. The side 78 of the tooth 74 is cylindrical with its center of curvature on the bearing surface 72. The radius of curvature r1 of the side 78 is calculated so that the side 78 makes a line contact with the sloped side 75 of the notch when the support 34 tilts under cam action, as set forth in the theory of cardanic motion described in the aforesaid U.S Pat. No. 4,393,820. The radius of curvature r2 of the side 77 is determined in a similar manner to assure the line contact with the side 73 The width of the guide slot 71 is selected relative to the width of the guide tooth 74 so that the tooth will be slidably received in the slot and will be operative to insure the relative rolling contact of bearing surfaces 70 and 72. While true cardanic motion as obtained by bearing surface radii ratio of 2:1 is preferred, slight deviations from that ideal may be acceptable, particularly where the maximum tilt angle of the support is small, although increased stresses are to be expected in that case.

Figure 8:
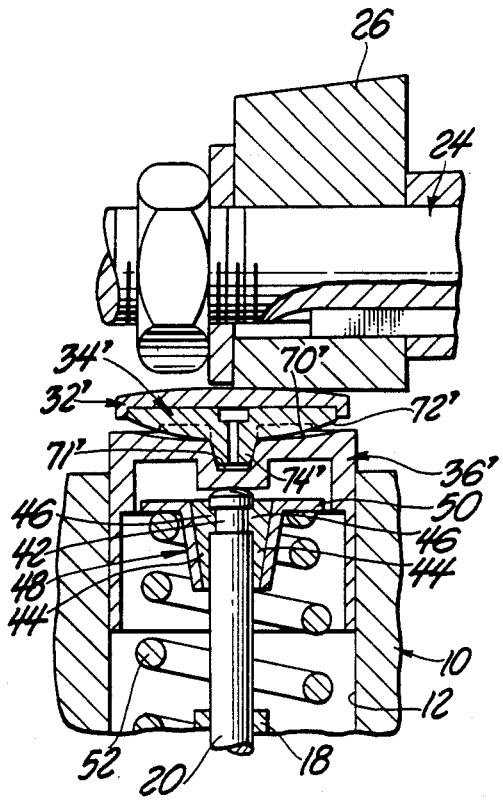

Another embodiment of the invention is shown in FIG. 8. The valve lifter shown there differs from that of FIG. 1 in two respects. First, the slot 71′ and tooth 74′ are located on a diameter of the retainer 36′ and the support 34′ and the bearing surfaces 70′ and 72′ are symmetrically disposed on either side of the tooth and slot. The principle of operation is the same as in FIG. 1 with cardanic rolling motion between the bearing surfaces. The second difference is that the retainer 36 and the follower body 38 of FIG. 1 are integrated into one piece 36′ in the FIG. 8 embodiment. Manufacturing expediency determines whether the parts should be separate or integrated.

The embodiments of the invention in which an exclusive property or privilege is claimed are defined as follows:

1. In an engine with an overhead camshaft having conical cams thereon that is axially shiftable to vary valve lift and with a head having a valve lifter guide bore, a direct acting cam follower valve lifter comprising;

a follower body having a tubular wall portion adapted to be slidably journaled in the lifter guide bore in the cylinder head, a follower retainer in one end of the follower body and having a concave outboard bearing surface adjacent said one end of the follower body, a shim support having a convex inboard bearing surface adapted to engage the outboard bearing surface of the retainer, and a shim supported on the outboard side of the shim support, the radius of the outboard bearing surface having a radius larger than the radius of the inboard bearing surface for rolling contact between the bearing surfaces, and one of the bearing surfaces having a guide recess and the other bearing surface having a guide extending into said guide recess for maintaining the rolling contact of the bearing surfaces.

2. In an engine with an overhead camshaft having conical cams thereon that is axially shiftable to vary valve lift and with a head having a valve lifter guide bore, a direct acting cam follower valve lifter comprising;

a follower body having a tubular wall portion adapted to be slidably journaled in the lifter guide bore in the cylinder head, a follower retainer in one end of the follower body and having an outboard bearing surface adjacent said one end of the follower body, a shim support having an inboard bearing surface adapted to engage the outboard bearing surface of the retainer, and a shim rotatably supported on the outboard side of the shim support, the outboard bearing and inboard bearing surfaces being of semi-cylindrical configuration with the radius of the outboard bearing surface having a radius R and the inboard bearing surface having a radius of about $1\frac{1}{2}$ R for cardanic rolling contact between the bearing surfaces, and the outboard bearing surfaces having a guide slot and the inboard bearing surface having a guide tooth extending into said guide slot for maintaining the rolling contact of the bearing surfaces.

3. The invention as defined in claim 2 wherein the follower retainer is integral with the follower body.

4. The invention as defined in claim 2 wherein the guide tooth and the guide slot are laterally spaced from the center axis of the follower body and the centers of curvature of the bearing surfaces are laterally spaced from the axis of the follower body in the direction of the guide tooth.

5. The invention as defined in claim 2 wherein the guide tooth and the guide slot are laterally spaced from the center axis of the follower body and the bearing surfaces are continuous surfaces extending from the guide tooth and guide slot, respectively, and through the center axis of the follower body to accommodate the desired amount of pivotal movement.

6. The invention as defined in claim 2 wherein the guide tooth and the guide slot are laterally spaced from the center axis of the follower body, the center of curvature of the bearing surface of the support lies on the axis of the guide tooth and guide slot, and the bearing surfaces are continuous surfaces extending from the guide tooth and guide slot, respectively, and through the center axis of the follower body to accommodate the desired amount of pivotal movement.

7. The invention as defined in claim 2 wherein the guide tooth and the guide slot are laterally spaced from the center axis of the follower body and the bearing surfaces are continuous surfaces extending from the guide tooth and guide slot, respectively, and through the center axis of the follower body to the edge of the shim support and follower retainer, respectively.

* * * * *